US009725136B1

(12) United States Patent
Silva

(10) Patent No.: US 9,725,136 B1
(45) Date of Patent: Aug. 8, 2017

(54) COLLAPSIBLE AND REMOVABLE COVER ASSEMBLY

(71) Applicant: ESM, LLC, Miami, FL (US)

(72) Inventor: Eddy Silva, Miami, FL (US)

(73) Assignee: ESM LLC, Miami, FL (US)

( * ) Notice: Subject to any disclaimer, the term of this patent is extended or adjusted under 35 U.S.C. 154(b) by 0 days.

(21) Appl. No.: 14/967,367

(22) Filed: Dec. 14, 2015

(51) Int. Cl.
*B63B 17/00* (2006.01)
*B63B 17/02* (2006.01)
*E04H 15/06* (2006.01)

(52) U.S. Cl.
CPC ..... *B63B 17/02* (2013.01); *E04H 15/06* (2013.01)

(58) Field of Classification Search
CPC ..... B63B 17/02; E04H 15/00
USPC ..... 114/361
See application file for complete search history.

(56) References Cited

U.S. PATENT DOCUMENTS 2,513,764 A 7/1950 Vonder
6,257,261 B1 * 7/2001 Johnson ..... B60R 9/12 114/343
6,968,800 B1 * 11/2005 Becht ..... B63B 17/00 114/361
8,950,416 B1 * 2/2015 Spellman ..... B63B 17/02 114/361

OTHER PUBLICATIONS http://www.windpaddle.com/product/windpaddle-sun-shades-large/ Extracted from internet on Apr. 23, 2017.*
http://shadedryboatfly.com/ Extracted from internet on Apr. 23, 2017.*

* cited by examiner

*Primary Examiner* — Anthony Wiest
(74) *Attorney, Agent, or Firm* — Christian Sanchelima; Jesus Sanchelima

(57) ABSTRACT

A removable cover assembly to provide or extend shading or precipitation coverage that can be mounted to a plurality of locations, including a fence or the rod holders of a boat. The cover assembly is collapsible for portability and ease of storage. The cover assembly further includes a cover unit mounted to the collapsible frame in a manner that creates a high arch to maximize airflow, shade, and clearance underneath the cover assembly. The entire present invention can be stored and transported in a slim storage assembly.

5 Claims, 12 Drawing Sheets

COLLAPSIBLE AND REMOVABLE COVER ASSEMBLY

BACKGROUND OF THE INVENTION

1. Field of the Invention

The present invention relates to a cover assembly and, more particularly, to a cover assembly that can be readily mounted to a plurality of objects and can be easily collapsed to be compactly stored or transported.

2. Description of the Related Art

Several designs for cover assemblies have been designed in the past. None of them, however, include a frame that can be quickly assembled and disassembled while having an anchoring assembly that can be easily mounted and removed from a list of fixed points.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a cover assembly that includes a frame that is quick and easy to assemble and disassemble to be compactly stored or transported.

It is another object of this invention to provide a cover assembly that is portable and extends a given coverage area or provides a coverage area.

It is another object of this invention to provide a cover unit including anchoring points that cooperate with a host of different mounting locations without affecting their structure.

It is still another object of the present invention to provide a cover assembly having a cover unit with a high arch to maximize airflow, coverage and clearance space underneath it.

It is yet another object of this invention to provide such a cover assembly that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
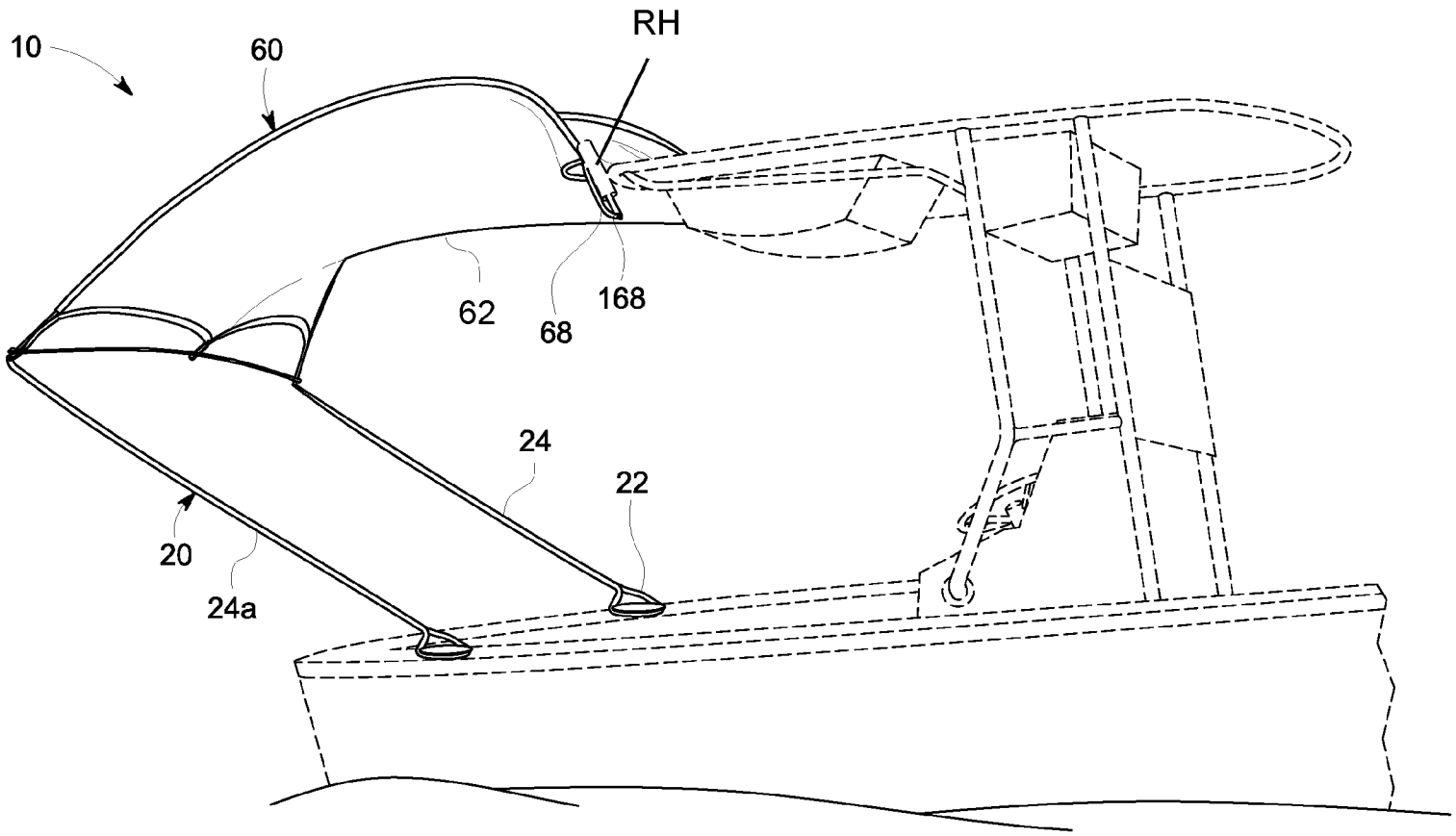
FIG. 1 represents an isometric view of the present invention mounted to the rod holders of a T-top style boat on one end and the boats' cleats on the opposite end.
Figure 1A:
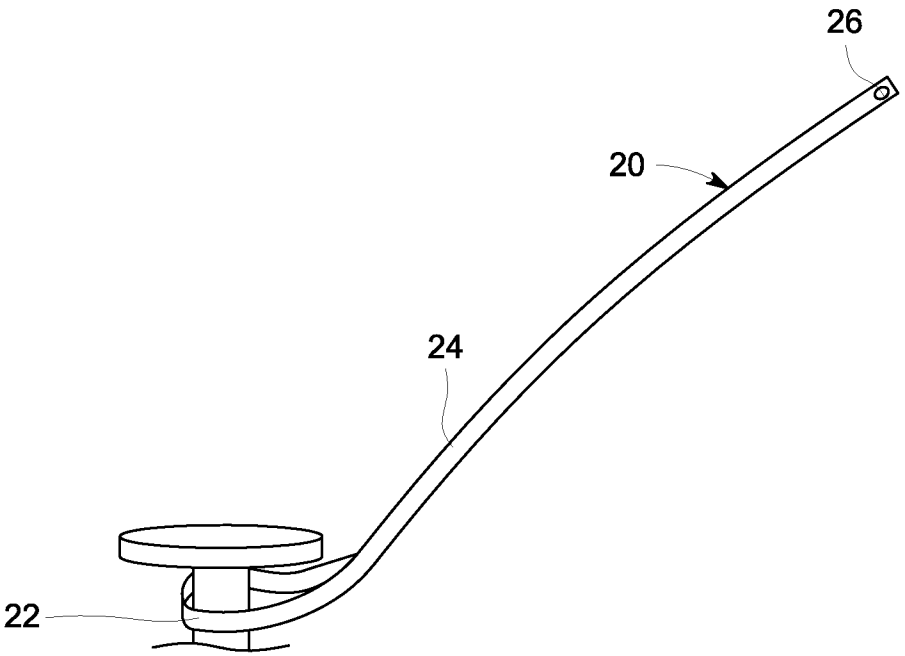
FIG. 1A is a side elevational view of loop assembly 20 showing loop member 22 at one end of strap member 24 and loop strap slot 26 at the opposite end.

Referring now to the drawings, where the present invention is generally referred to with numeral 10, it can be observed that it basically includes loop assembly 20, pole assembly 40, cover assembly 60, transverse pole assembly 80, and storage assembly 100.

Loop assembly 20 includes two loop members 22; 22*a*, having loop strap 24; 24*a*, and loop strap slots 26; 26*a*, respectively. To begin mounting the present invention to a boat, loop members 22; 22*a* are mounted to the cleats of the boat as shown in FIG. 1. Loop straps 24; 24*a* then extend away from the cleats of the boat and will be used in subsequent steps to mount loop assembly 20 to pole assembly 40.

Figure 2:
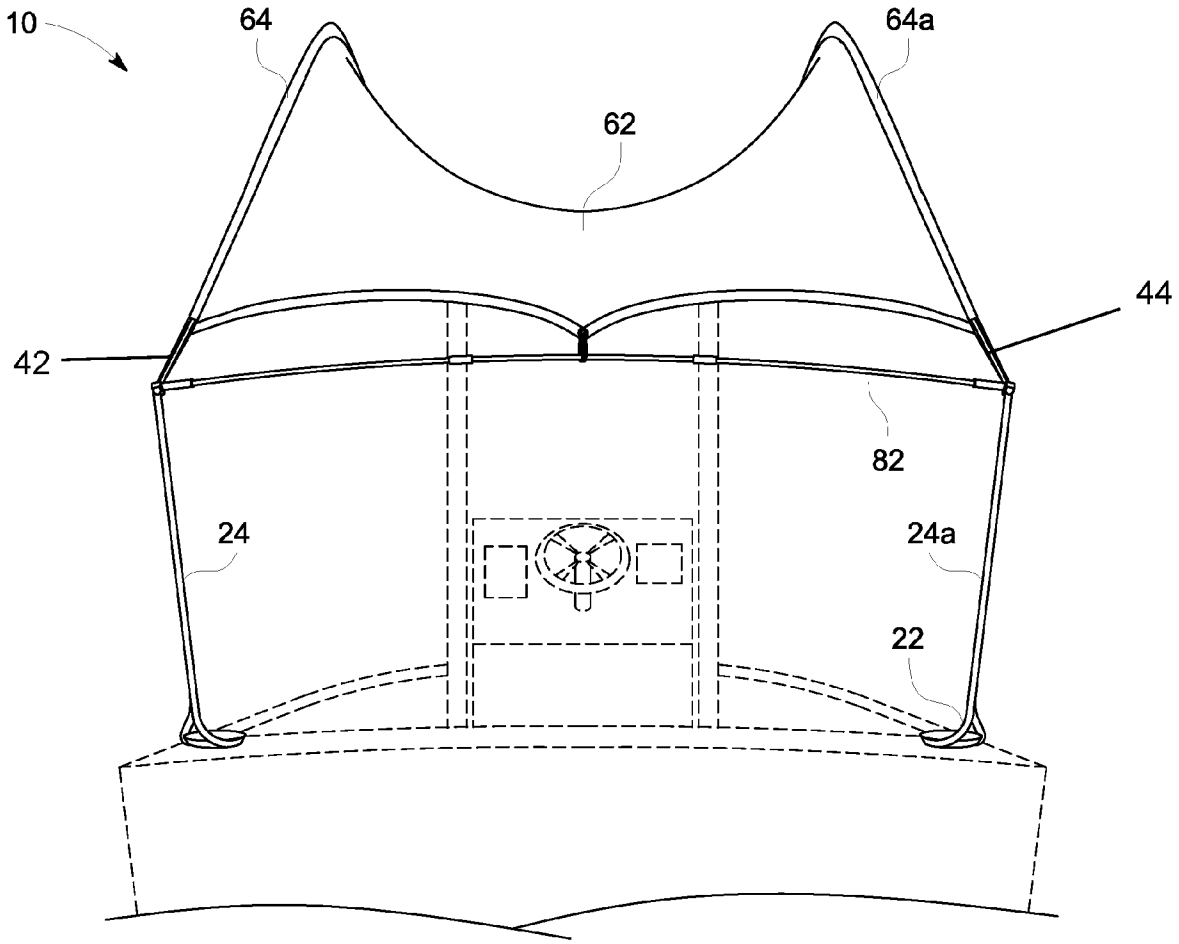
FIG. 2 shows a rear elevational view of the present invention wherein the arch of cover unit 62 can be seen.
Figure 7:
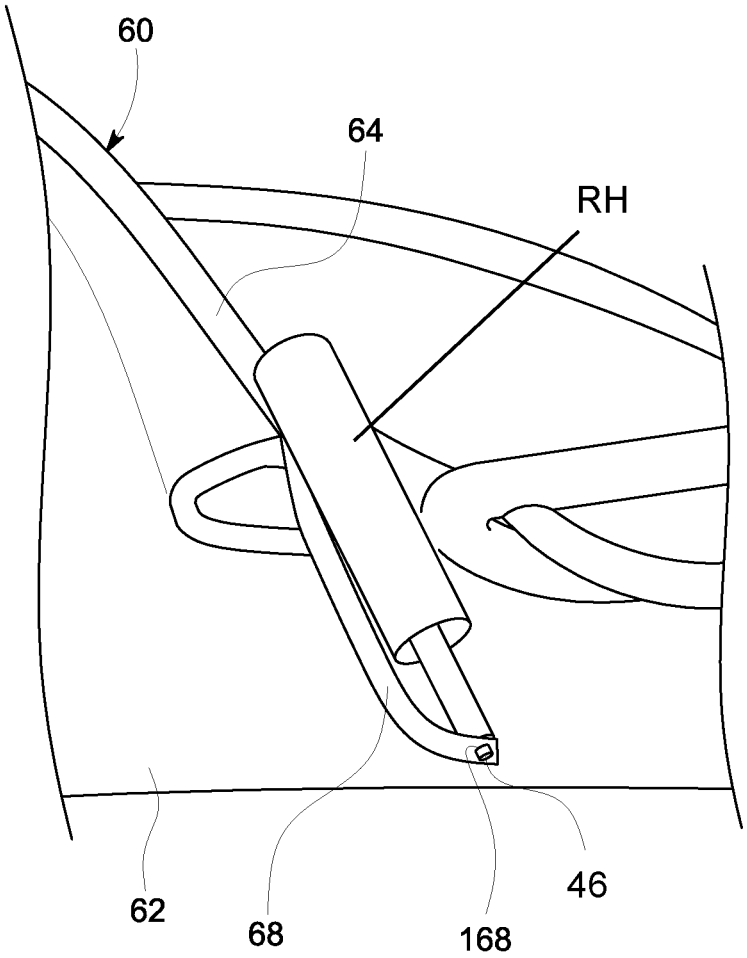
FIG. 7 is a partial isometric view of fishing rod holder RH having the bottom of pole assembly 40 extending therefrom and having second extension strap 68 mounted thereon using second grommet tip 43.

Pole assembly 40 includes two pole sets. First pole set 42 is comprised of first pole member 142, second pole member 144, third pole member 146, and fourth pole member 148. Alternatively, first and second pole sets 42; 44 can include more or fewer pole members. Pole assembly 40 further includes a second pole set 44 comprised of pole members 242, 244, 246, and 248. First and second pole sets 42 and 44 are configured into their longitudinally straight position, as shown in FIG. 2A, and passed through the bottom of a boat's fishing rod holders RH, as seen in FIG. 7.

Figure 2B:
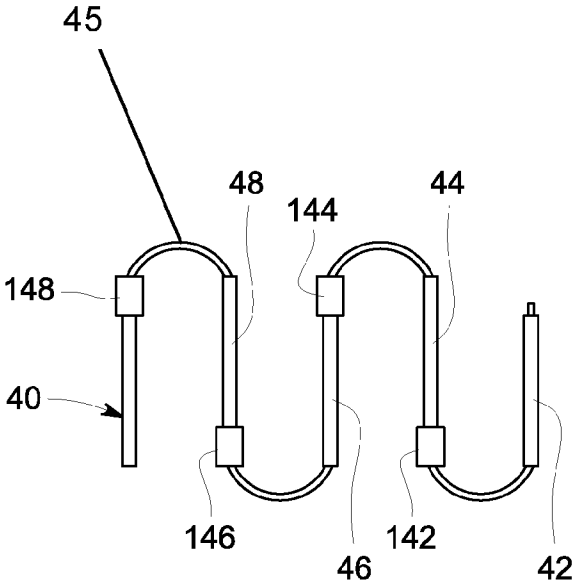
FIG. 2B is a top plan view of pole assembly 40 having the pole members separated to show elastic band 45.
Figure 2A:
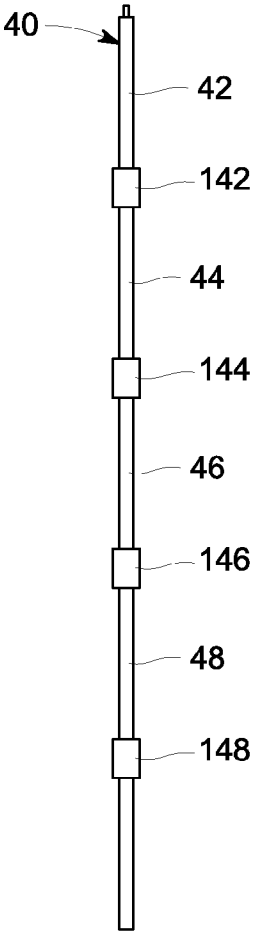
FIG. 2A is a front elevational view of pole assembly 40 in its assembled configuration.

As seen in FIG. 2B, all the pole members of first and second pole set 42; 44 are kept together using elastic bands 45 and 45*a* (not shown), respectively. Elastic bands 45; 45*a* also biases each pole member towards each other in order to securely lock them together when in the assembled configuration shown in FIG. 2A. For ease of understanding, pole assembly 40 includes components similar to those used with conventional camping tents.

Figure 3:
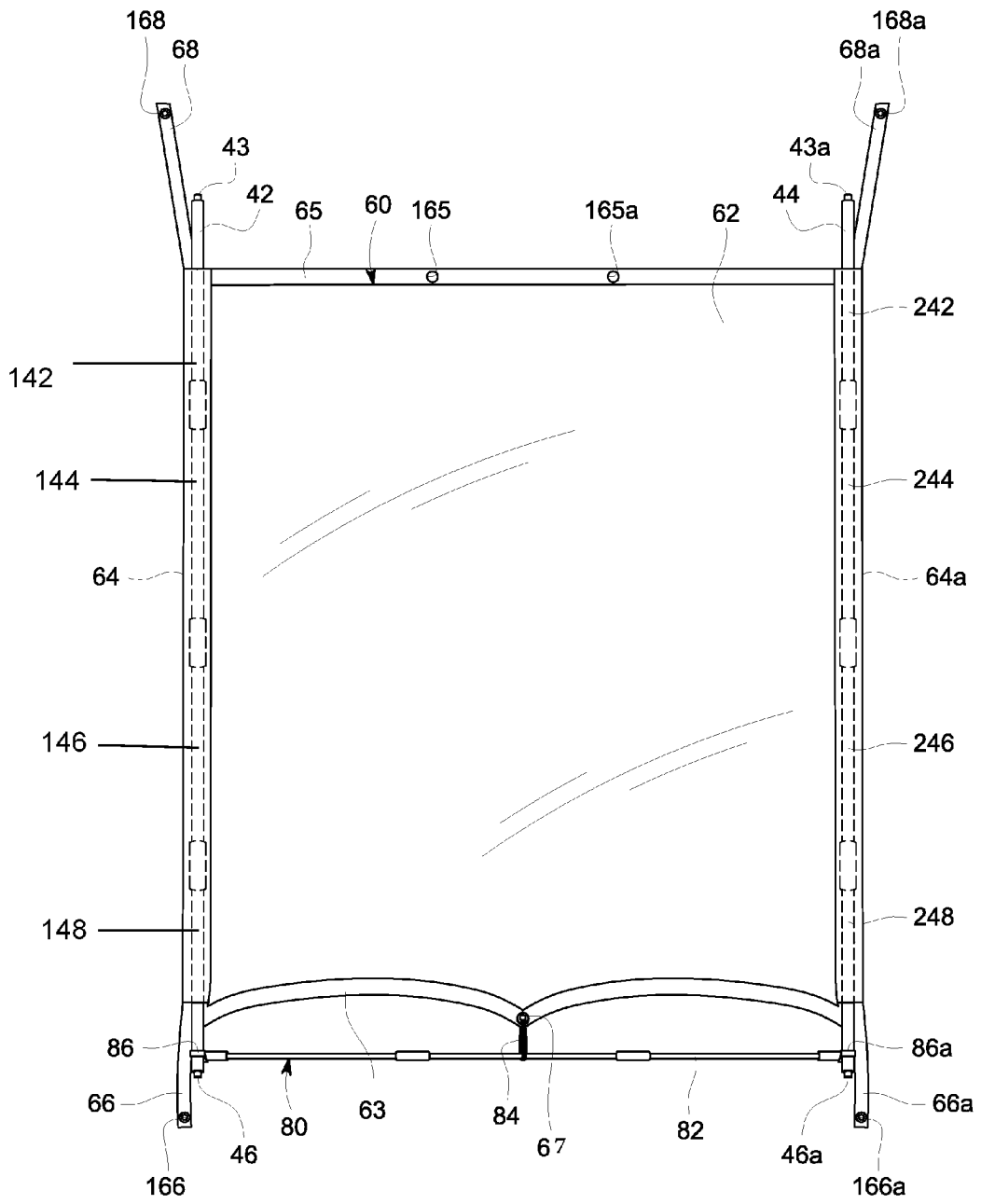
FIG. 3 illustrates a top partial see-through view of the present invention wherein pole assembly 40 is shown in its assembled configuration and passed through sleeves 64; 64*a*.

After partially passing first and second pole sets 42; 44 up through two fishing rod holders RH that are spaced apart a distance that cooperates with the width of cover unit 62, they are inserted through sleeves 64; 64*a* of cover assembly 60. As shown in FIG. 3, cover assembly 60 further includes sleeves 64; 64*a* that are spaced apart and parallel with respect to each other and located at the side distal ends of cover 62. Cover assembly 60 also includes first cover extension members 66; 66*a* that include extension slots 166; 166*a* and can extend from the corner between bottom distal trim 63 of cover 62 and sleeves 64; 64*a*, respectively.

Figure 5:
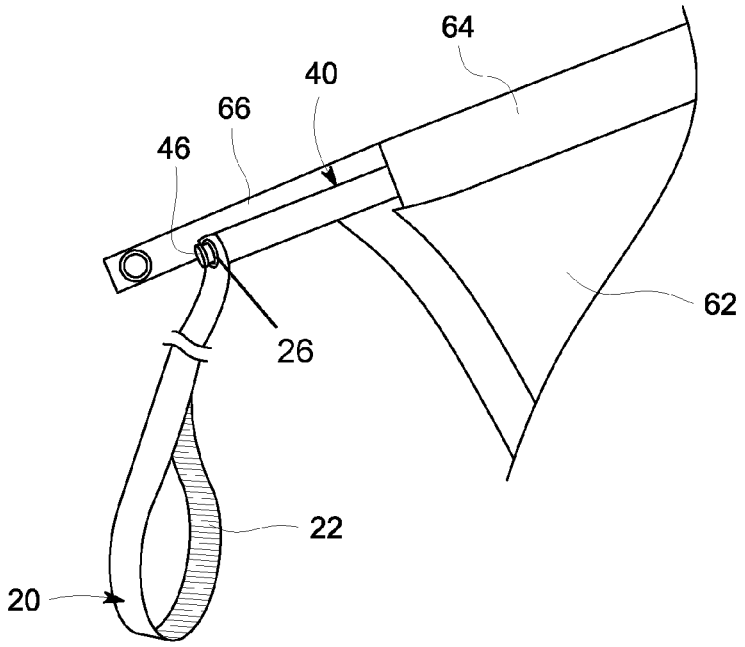
FIG. 5 shows the first part of the sequence to secure loop assembly 20 to pole assembly 40.
Figure 5A:
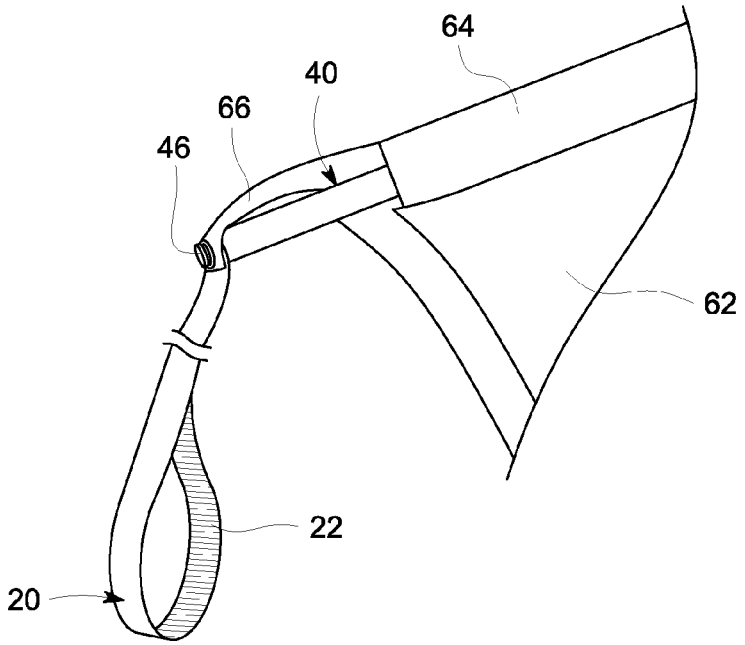
FIG. 5A shows the second part of the sequence to secure loop assembly 20 to pole assembly 40 wherein cover extension member 66 is put over loop strap slot 26, which is mounted to grommet tip 46.
Figure 6:
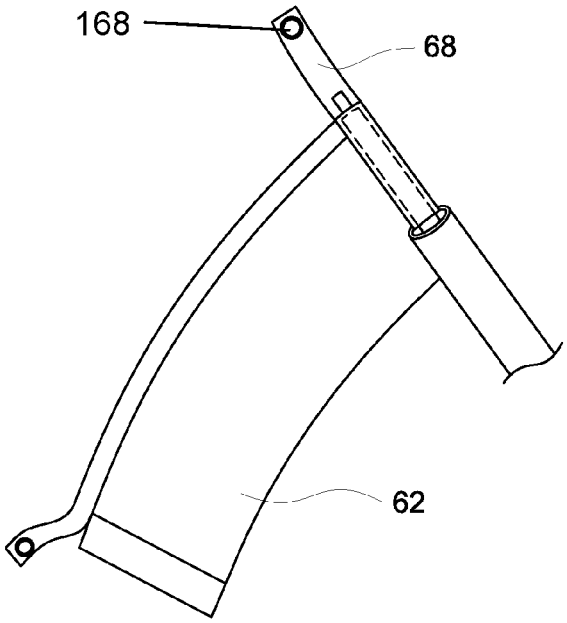
FIG. 6 shows an isometric partial view of cover unit 62 with first cover extension 66 extending past its bottom distal end.
Figure 6A:
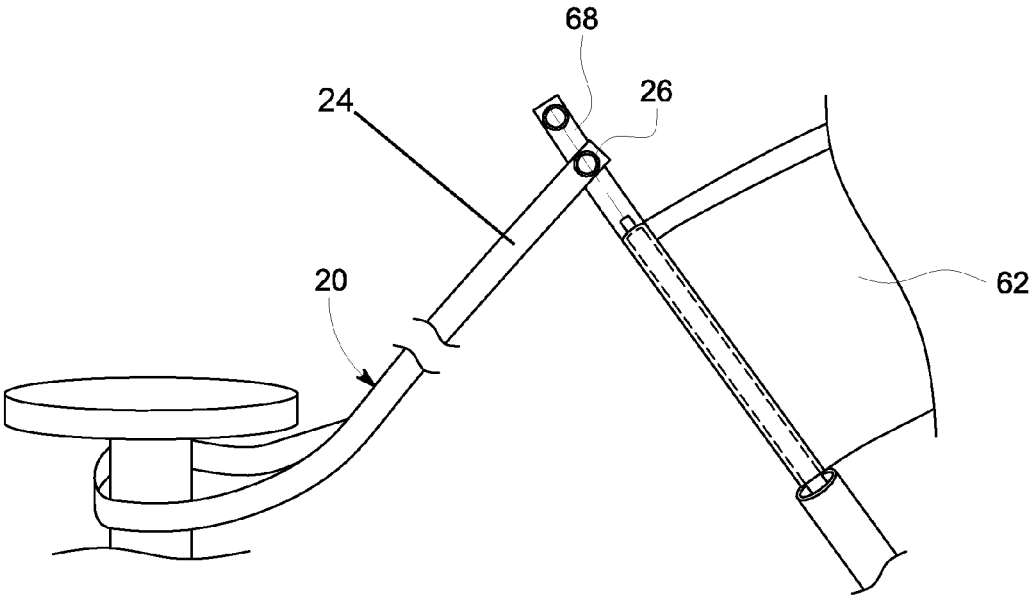
FIG. 6A illustrates a partial view of loop assembly 20 mounted on one end to a cleat and one second end showing a positioning between first cover extension 68 and loop strap 24 prior to them being mounted to grommet tip 46.

Cover assembly 60 also includes second cover extensions 68; 68*a* that extend from the top of sleeves 64; 64*a*, respectively. Second cover extensions 68; 68*a* include anchoring slots 168; 168*a* at their distal ends. Cover unit 62 also includes top trim 65 having grommet openings 165; 165*a* at a predetermined spaced apart distance with respect to each other. First cover extension members 66; 66*a* are extended a predetermined distance so that extension slots 166; 166*a* can cooperatively engage pole set grommet tips 46; 46*a*, respectively, as seen in FIGS. 5 and 5A.

The next step after pole assembly 40 has been partially passed through rod holder RH and through sleeves 64; 64*a* is to mount loop strap slots 26; 26*a* to grommet tips 46; 46*a*. Pole sets 42; 44 are then continued to be passed through rod holders RH and fed through sleeves 64; 64*a* until only a small portion remains not having been passed through rod holders RH as seen in FIG. 7. For ease of insertion through sleeves 64; 64*a* it can be helpful to compress the sleeves to pass pole sets 42; 44 through them quicker and with less resistance and then extend the sleeves along the pole sets that are already therein and have been inserted up through rod holder RH. At this point, a user then grasps second cover extensions 68; 68*a* to hold cover assembly 60 in place while the user continues to feed pole member sets 42; 44 through fishing rod holders RH. As a user continues to pass the pole member sets 42; 44 through fishing rod holders RH, they begin to arch downward, due to the tension created by loop straps 24 biasing them downwards towards the cleats, creating the arch shown in FIGS. 1 and 2.

Figure 3A:
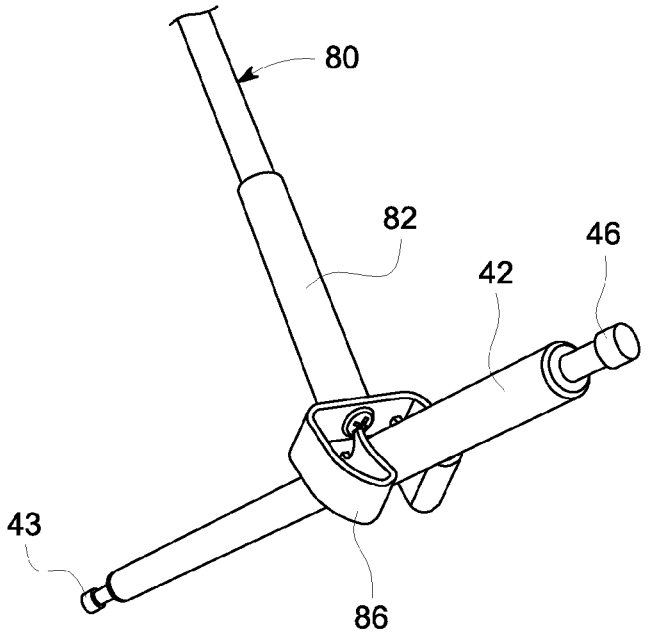
FIG. 3A is a representation of an enlarged view of the connection between first pole set 42 and transverse pole assembly 80 using clamping members 86.
Figure 3B:
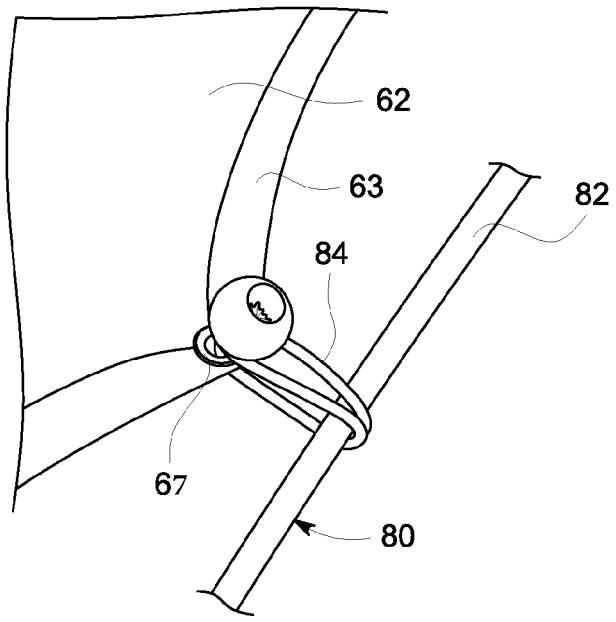
FIG. 3B is an enlarged view of fastening member 84 mounting transverse rod member 82 to cover unit 62.
Figure 3C:
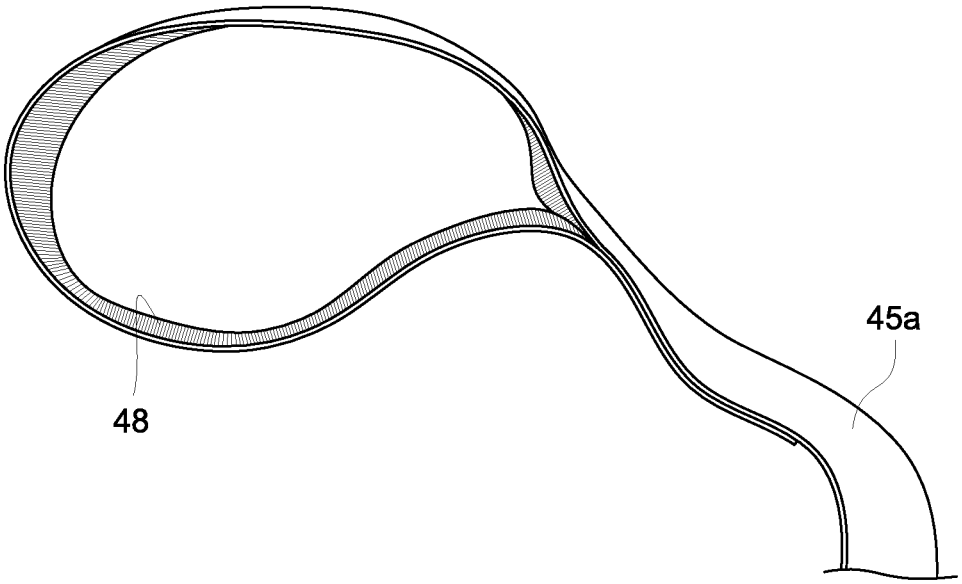
FIG. 3C is an enlarged view of loop strap 24 seen at the distalmost end of cover extension 66.

Transverse pole assembly 80 is then used, as seen in FIGS. 2 and 3A, to provide stability to the present invention's structure by not allowing pole sets 42; 44 to collapse inwardly. Transverse pole assembly 80 includes transverse member 82 which includes fastening member 84 that loops around it and engages cover slot 67 located between first cover extensions 66; 66*a*, as seen in FIGS. 3 and 3B. Transverse member 82 further includes clamp members 86; 86*a* located at its distalmost ends. As shown in FIGS. 2 and 3A, clamp members 86; 86*a* are used to mount transverse pole assembly 80 to first and second pole sets 42 and 44.

Transverse pole assembly 80 keeps cover unit 62 in its working position by keeping it taught and thus provides the greatest amount of shade possible. Once pole set members 42; 44 are passed through fishing rod holders FH, second cover extensions 68; 68*a* are pulled downwardly to the bottom end of their respective fishing rod holders as seen in FIG. 7. Second cover extensions 68; 68*a* are subsequently mounted to top grommet tips 46; 46*a*, thereby securing pole set members 42; 44 and not allowing them to slip out of fishing rod holders RH.

Figure 4:
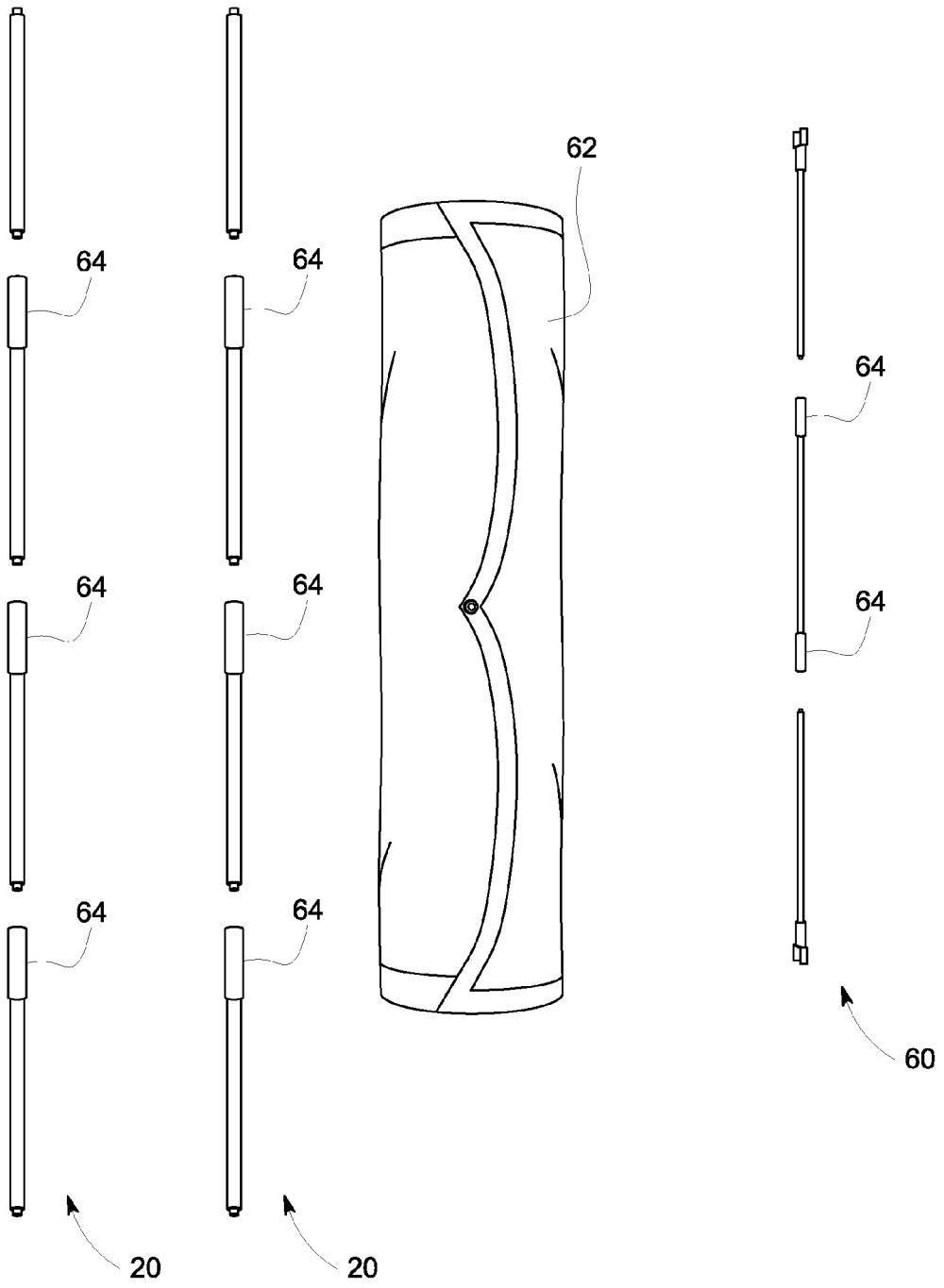
FIG. 4 shows an exploded view of first and second pole sets 42 and 44 in their disassembled configuration with cover unit 62 rolled up and transverse member 82 also shown in an exploded view.
Figure 4A:
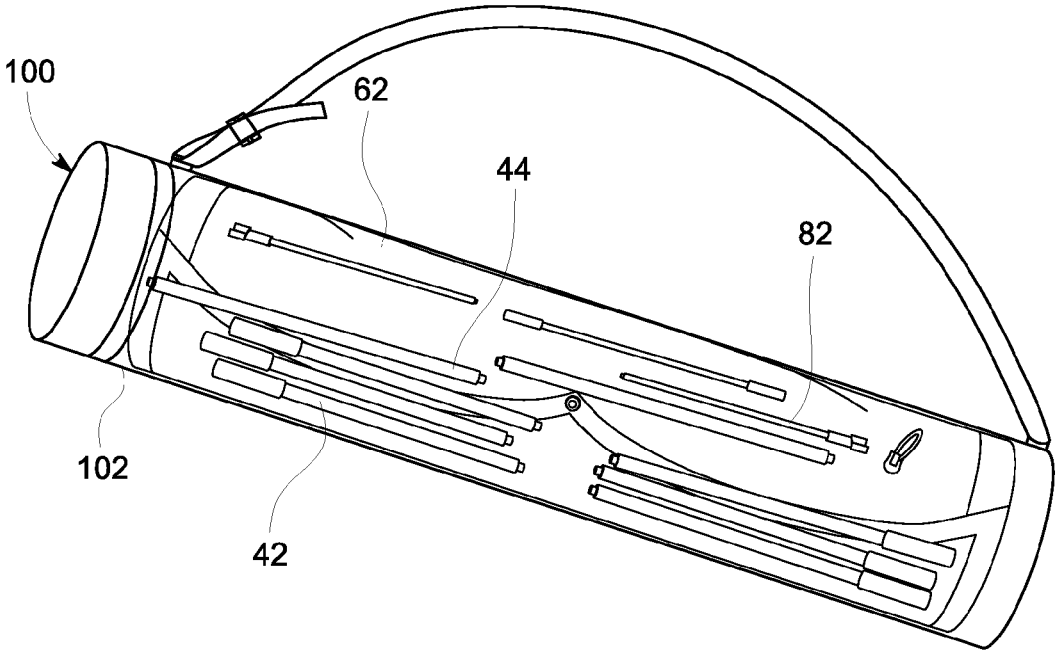
FIG. 4A is a side view of storage assembly 100 having the rest of the components of the present invention packed therein.

As seen in FIG. 4A, storage assembly 100 includes storage member 102 that is a cooperative dimension to store the present invention in its compact configuration for ease of storage and transportation. Optionally, storage member 102 can have a slim, telescope configuration to adjust its dimensions based on the size embodiment of the present invention.

In an optional embodiment, cover assembly 60 further includes grommet openings 165; 165*a* at determined location on top trim 65. Fastening members similar to fastening member 84 are passed through grommet openings 165; 165*a* and are each mounted to an empty fishing rod holder in between the fishing rod holders RH used for pole set members 42; 44.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A collapsible portable cover comprising:

a. two pole sets each comprised of a plurality of pole members connected together using an elastic band, said pole sets having a grommet tip at their bottommost and topmost distal ends;

b. a cover assembly having a cover unit, two sleeves, a bottom trim, a top trim, and two side distal ends, said sleeves having a bottom closer to a boat's stern and a top closer to a boat's bow, said sleeves running longitudinally along said side distal ends, said sleeves having an interior space to each receive each of said pole sets;

c. said cover assembly including two back cover extensions on opposite sides of said cover unit and extending from a location of said bottom trim that is adjacent to said sleeves, said cover assembly further including two front cover extensions on opposite sides of said cover unit and extending from said top trim adjacent at a location adjacent to said sleeves;

d. a plurality of spaced apart fishing rod holders mounted on a boat's t-top, said pole sets being passed through a predetermined distance out of two preselected rod holders and each inserted into one of said sleeves;

e. a loop assembly including two loop straps each having a first and second end, said first ends include a loop member that is mounted to a boat's cleat and said second ends include a loop member slot that is cooperatively mounted to said bottommost grommet tip, said two back cover extensions each having a distal end that includes an extension slot, said back cover extensions being longer than the amount of said pole sets that extend outside the bottom of said sleeves, said back cover extensions each mounted over each of said loop member slots, thereby securing said loop members to said grommet tips;

f. said pole sets passed through said rod holders thereby creating an arch in said cover unit using the tension from said loop members mounted to said cleats, said pole sets passed through until only a small portion of each is left not having been passed by their respective rod holders, said front cover extensions mounted onto said topmost grommet tips preventing said pole sets from sliding out of said rod holders.

2. The cover subject of claim 1 wherein a transverse rod member is mounted perpendicularly to each of said pole sets when passed substantially through said rod holders, thereby keeping said cover unit taught.

3. The cover subject of claim 2 wherein a storage assembly is used to store and transport said pole sets, said cover unit, and said transverse pole.

4. The cover subject of claim 1 wherein said bottom trim includes an opening that cooperates with a fastening member to allow said fastening member to pass through said opening and mount said bottom trim to said transverse pole.

5. The cover subject of claim 1 wherein said top trim includes two openings spaces apart a predetermined distance that allow a plurality of fastening members to cooperatively pass through to mount said top trim to a boat's fishing rod holders not being used by said pole sets.

* * * * *